United States Patent [19]

Simpson et al.

[11] Patent Number: 4,697,403

[45] Date of Patent: Oct. 6, 1987

[54] BAG SPREADERS

[75] Inventors: William W. Simpson; Irvin G. Fulton, both of Durham, N.C.

[73] Assignee: USM Corporation, Farmington, Conn.

[21] Appl. No.: 820,283

[22] Filed: Jan. 16, 1986

[51] Int. Cl.[4] ..... B65B 9/08

[52] U.S. Cl. ..... 53/551

[58] Field of Search ..... 53/551, 552, 554, 381 R; 493/302, 308

[56] References Cited

U.S. PATENT DOCUMENTS

| | | | |
|---|---|---|---|
| 3,045,404 | 7/1962 | Wilson | 53/551 |
| 3,681,892 | 8/1972 | Safranski | 53/551 |
| 3,886,714 | 6/1975 | de la Poype | 53/551 |
| 4,107,900 | 8/1978 | Izumi | 53/381 R |
| 4,589,247 | 5/1986 | Tsuruta | 53/551 |

*Primary Examiner*—Robert L. Spruill
*Assistant Examiner*—Donald R. Studebaker
*Attorney, Agent, or Firm*—Cohen, Pontani & Lieberman

[57] ABSTRACT

An apparatus for flattening the horizontal seal area of a form-fill-seal pouch or bag comprising a pair of spreaders adapted to be located in the interior of the film pouch to stretch the film in the horizontal seal area to eliminate wrinkles in the film to insure an air-tight seal.

2 Claims, 4 Drawing Figures

BAG SPREADERS

BACKGROUND OF THE INVENTION

1. Field of the invention

This invention relates to an apparatus for spreading and flattening the end seal area of vertical form-fill-seal bags or pouches to prevent wrinkles in the end seals to insure air-tight packages.

2. Statement of the Prior Art

In the art of automatically forming, filling and sealing pouches or packages, one approach is to feed a film around a forming collar into a tubular shape about a vertical forming tube. A vertical seal is made in the film and horizontal sealing dies seal the lower end of the film tube. A product is fed down the tube and into the formed pouch. The horizontal sealing dies then seal the film tube to form the upper end of the filled pouch and the lower end of the next pouch and a cutter removes the formed-filled-sealed pouch from the tube. Apparatus of this type is illustrated in U.S. Pat. No. 4,277,302.

In apparatuses of this type, it is desirable to prevent wrinkles in the horizontal end seals of the pouch to insure that the pouch is air tight. This is particularly true when outer pouches are formed around plastic bags of liquid and the completed pouch with its inside liquid bag are heat sterilized. There can be no air leaks in the outer pouch and thus all wrinkles in the film tube have to be removed when making the horizontal seals.

SUMMARY OF THE INVENTION

It is an object of this invention to produce wrinkle free pouches on vertical form-fill-seal machines when packaging relative heavy products.

It is also an object of this invention to spread a pouch from the inside to stretch the seal area flat before applying the top and bottom seal.

It is a further object of this invention to provide a pair of movable spreaders attached to the bottom of the forming tube of a vertical form-fill-seal packaging apparatus so that the wrinkles in the end seals can be removed when forming the horizontal seal in the pouch. After a product has been fed down the inside of the forming tube and into the film tube, and before the horizontal sealing dies seal the pouch, the spreaders are moved outwardly stretching the film tube open to provide a flat area for the horizontal seal in the top of the filled pouch and the bottom of the film tube. In this manner, the wrinkles in the horizontal seal are removed to insure that the filled pouch is air tight and will not leak.

It is an additional object of this invention to attach film spreaders to the forming tube of form-fill-seal packaging machine by means of spring hinges. An air cylinder moves a linkage forcing actuator rods inside the forming tube downward to move the spreaders outward to stretch the film tube flat at the horizontal seal area of the film tube. As the film is drawn over the tube former and around the tube, at the appropriate time in the pouch-forming cycle, just prior to sealing the top of the filled pouch and bottom of the film tube, the air cylinder is actuated causing the actuator rods to move downward pivoting the spreaders on their spring hinges. This action stretches the film to flatten out the film material prior to applying the top and bottom horizontal seals on the pouch.

DESCRIPTION OF THE PREFERRED EMBODIMENT

Figure 1:
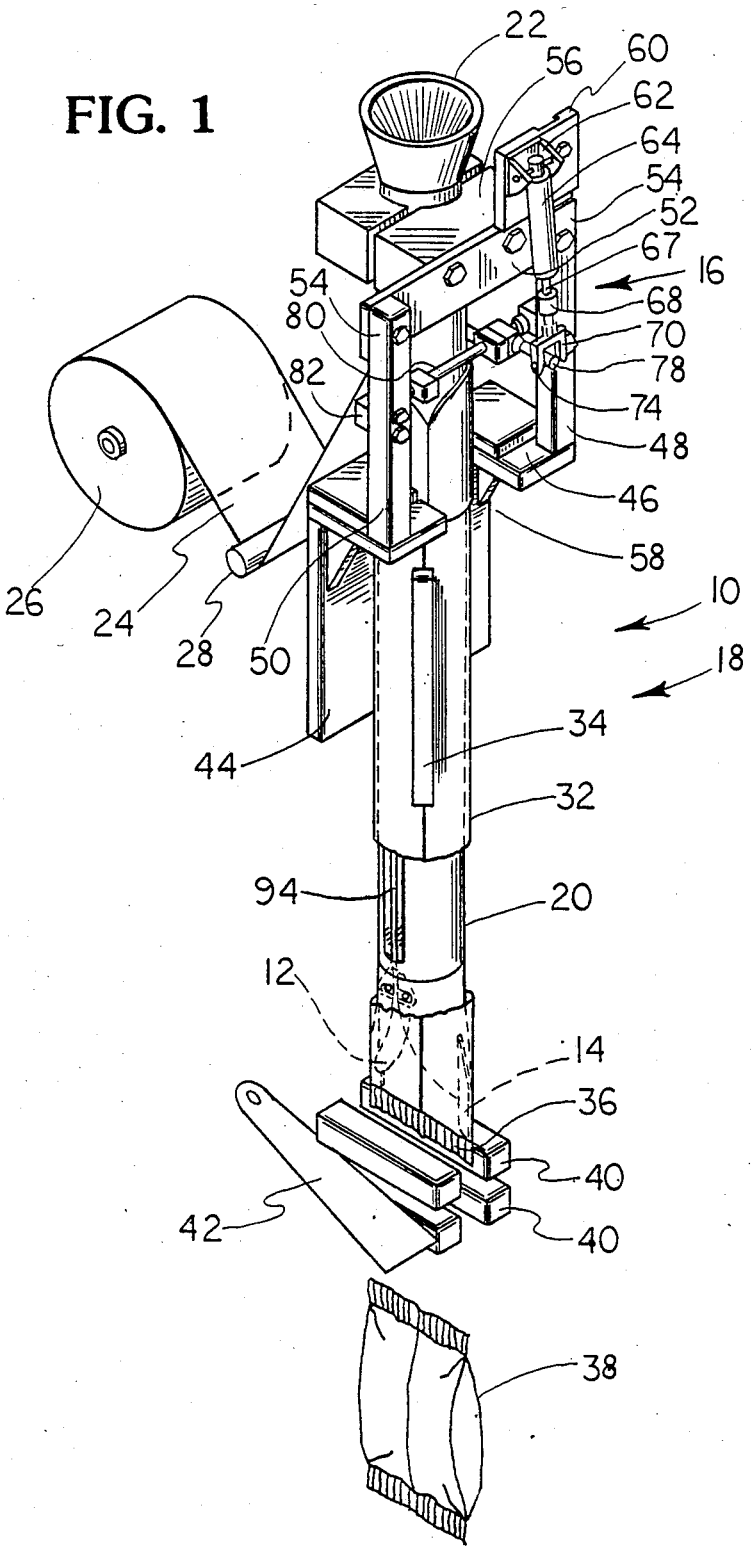
FIG. 1 is a diagrammatic perspective view of a vertical form-fill-seal packaging machine incorporating the bag spreader apparatus of this invention.

Attention is directed to FIG. 1 which illustrates the bag spreader apparatus 10 comprising a pair of bag spreaders 12 and 14 and a spreader actuating mechanism 16 being used on a vertical tubular form-fill-seal packaging machine 18. It will be appreciated, however, from the accompanying description that the spreader apparatus of this invention can be utilized on other packaging machines to spread the packaging material at the inside of the pouch to remove wrinkles at the horizontal seal area to eliminate leaks in the pouch seals.

Figure 2:
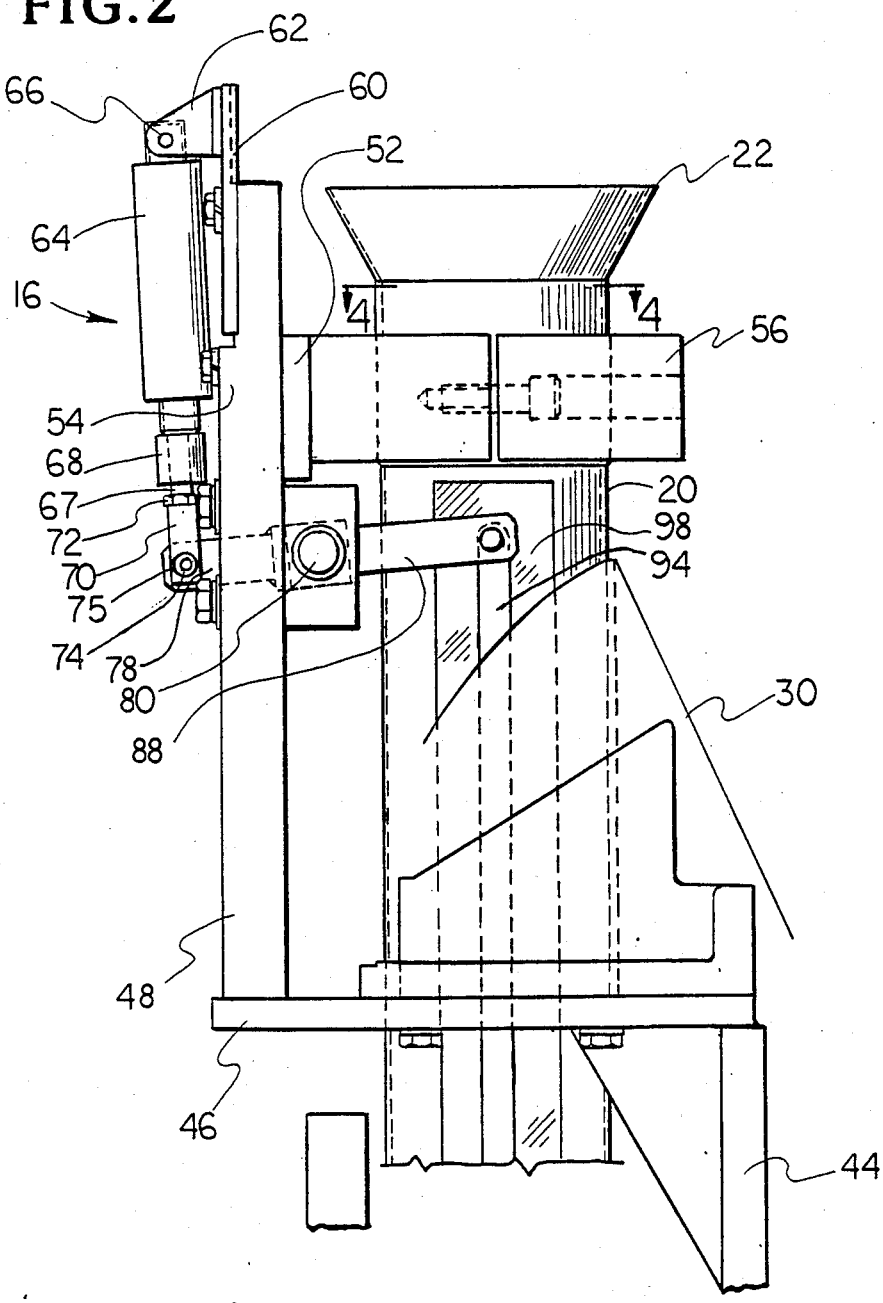
FIG. 2 is an enlarged side elevational view of the spreader actuating mechanism.

The packaging machine 18 comprises an open vertical cylindrical tube 20 having a funnel 22 for receiving the product to be packaged. A film 24 of packaging material is carried on a roll 26 and passes through idler roller 28 and around a conventional tube former 30, diagrammatically illustrated in FIG. 2. The film passes around the tube 20 and a vertical seal is formed in the film to make a film tube 32 by any conventional means such as a heater 34. The film is drawn off the roll 26 through the tube former 30 and down tube 20 by any conventional means such as film drive belts (not shown). The horizontal seal 36 on the pouch 38 is formed by horizontal sealing dies 40 which form the upper seal on the lower pouch and the lower seal on the upper film tube (see FIG. 1). A cutter 42 passing between the sealing dies 40 severs the filled pouch 38.

Located in the environment of the above described vertical form-fill-seal packaging apparatus 18 is the bag spreader apparatus 10 comprising a spreader actuating mechanism 16 having a support arm 44 adapted to be attached to the machine frame (not shown). A U-shaped platform 46 is carried on arm 44 and has support posts 48, 50 mounted thereon. A cross bracket 52 is secured to the upper ends 54 of posts 48, 50. Bracket 52 carries a collar 56 which surrounds tube 20, with the tube 20 extending downwardly through the opening 58 in platform 46 (see FIG. 1).

A plate 60 is attached to post 48 and carries a bracket 62 supporting the upper end of air cylinder 64 by pin 66. The cylinder rod 67 extends through a spacer 68 and is threaded into a U-shaped arm 70 (see FIG. 1). An adjustment screw 72 is threaded onto rod 67 to rotationally lock the arm 70 on rod 67. A cross pin 74 in arm 70 is carried in a bushing 76 in arm 78 secured to a shaft 80 carried in bushings 82, 84 mounted on posts 48, 50. Set collars 86 are located on shaft 80 to secure the shaft 80 in bushings 82, 84. Secured to shaft 80 and extending outwardly on each side of the tube 20 are arms 88.

Figure 4:
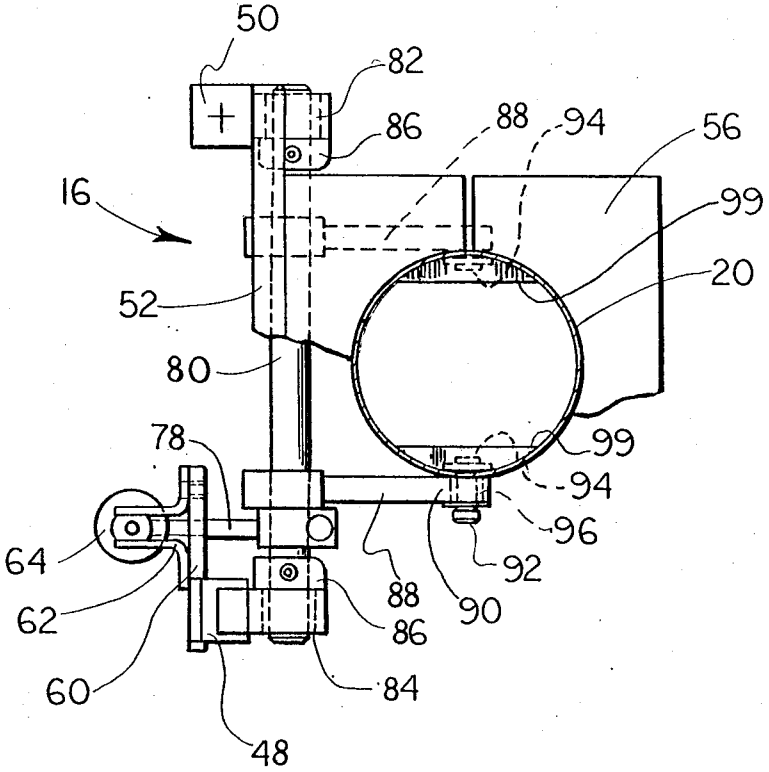
FIG. 4 is a sectional view taken along the lines 4—4 of FIG. 2.
Figure 3:
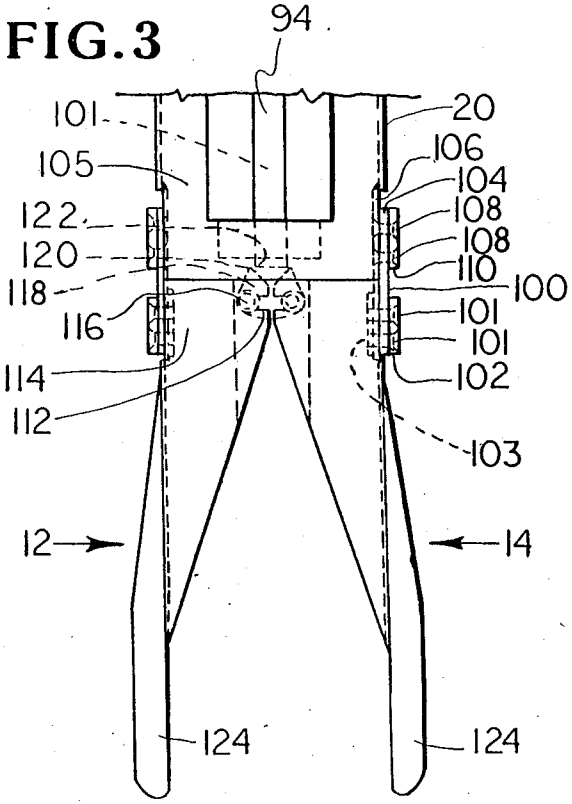
FIG. 3 is a side elevational view of the spreaders.

Attached to the ends 90 of arms 88 by screws 92 are actuator rods 94 passing down the flat side 99 of the tube 20 (see FIG. 4). The lower ends 101 of rods 94 pass into the interior of the lower end 105 of tube 20 as shown in FIG. 3. The screws 92 are mounted in bushings 96 in arms 88 and are threaded into the upper end of actuator rods 94. From the above description, it can be seen that retraction of the cylinder rod 67 will rotate shaft 80 and pivot arms 88 (clockwise in FIG. 2) causing the actuator rods 94 to be lowered.

Attention is now directed to FIG. 3 which illustrates the mounting of spreaders 12, 14. The spreaders 12, 14 are semi-conical in configuration and are each attached to a leaf spring 100 by screws 101 which pass through a clamp plate 102 and into a nut plate 103 secured to vanes 12, 14. The upper end 104 of leaf springs 100 are attached to the extension 106 secured to the lower end of the tube 20. Screws 108 pass through a clamp plate 110 and are threaded into the extension 106 on the tube 20. Mounted in slots 112 in the upper ends 114 of spreaders 12, 14 are pins 116 each of which carry opposed plates 118 which are in the interior of tube 20. The plates 118 have ears 120 positioned adjacent the corners 122 of the end of actuator rods 94.

In the operation of the film spreader, as the actuator rods 94 are lowered (as described above), the corners 122 of rods 94 will contact the ears 120 on plates 118, forcing the pins 166 in slots 112 outwardly. This will pivot the spreaders 12, 14 on leaf springs 100 to separate the spreaders. At this point, the outwardly and downwardly extending vanes 124 on spreaders 12, 14 will flatten the film to eliminate any wrinkles in the film at the location of the sealing dies 40. This will permit a flat seal of the film to eliminate any leaks in the formed pouch.

We claim:

1. An apparatus for use in a form-fill-seal packaging machine for removing the wrinkles in the packaging film at the horizontal seal area, comprising:

a. a support means;

b. a form-fill mechanism on said support means including a tube former for forming the film into a predesired packaging configuration and a tube about which the film is formed, said tube having a lower open end portion through which a product passes into the formed film;

c. a pair of leaf springs each of which are attached to said tube lower end portion;

d. a pair of semi-conical spreaders extending downardly from and operably forming an effective continuation of the lower portion of said tube, each attached to a respective one of said leaf springs, said spreaders each having outwardly extending vanes for positioning within said film;

e. means for outwardly pivoting said spreaders against the return urgency of said leaf springs to cause said vanes to act on said film to stretch the film to remove wrinkles therein at the horizontal seal area, f. said means comprising a linkage pivotally mounted on said support and carrying above said tube former a pair of opposed actuator rods postioned inside said tube, each of said rods having a lower end portion coacting with said semi-conical spreaders; and g. means to pivot said linkage to move said rods downwardly to move said spreaders outwardly.

2. The apparatus of claim 1 wherein each of said spreaders have opposed slots, each of said slots carrying a pin supporting plates against which said rod lower end portions act to move said spreaders outwardly.

* * * * *